US005752141A

United States Patent [19]

Nishimura et al.

[11] Patent Number: 5,752,141

[45] Date of Patent: May 12, 1998

[54] ROTATING TYPE DEVELOPING APPARATUS

[75] Inventors: Masayuki Nishimura; Yuusaku Hashimoto; Takeshi Okoshi; Yoshifumi Ozaki; Katsumi Harumoto; Hideo Nagura; Toshio Uchida, all of Iwatsuki; Kei Hirata, Ebina; Atsuyuki Kitamura, Ebina; Ikutaroh Nagatsuka, Ebina, all of Japan

[73] Assignee: Fuji Xerox Co., Ltd., Tokyo, Japan

[21] Appl. No.: 796,401

[22] Filed: Feb. 6, 1997

[30] Foreign Application Priority Data

Feb. 9, 1996 [JP] Japan ..... 8-024085

[51] Int. Cl.[6] ..... G03G 15/01

[52] U.S. Cl. ..... 399/227

[58] Field of Search ..... 399/222, 223, 399/227, 226

[56] References Cited

U.S. PATENT DOCUMENTS

| | | | |
|---|---|---|---|
| 4,707,108 | 11/1987 | Akio | 399/227 |
| 4,713,673 | 12/1987 | Kessoku | 399/227 |
| 4,728,987 | 3/1988 | Diola et al. | 399/227 |
| 5,198,866 | 3/1993 | Kimura et al. | 399/222 |

FOREIGN PATENT DOCUMENTS

| | | |
|---|---|---|
| 2-21591 | 5/1990 | Japan . |
| 5-289504 | 11/1993 | Japan . |
| 6-19306 | 1/1994 | Japan . |
| 6-308829 | 11/1994 | Japan . |

*Primary Examiner*—S. Lee

*Attorney, Agent, or Firm*—Finnegan, Henderson, Farabow, Garrett & Dunner, L.L.P.

[57] ABSTRACT

A rotating type developing apparatus, having a plurality of developing devices which convey developer, which at least includes toner and carrier, to a developing roll while accommodating and circulating the developer; and a rotating body which holds and rotates the plurality of developing devices, in a rotating type developing apparatus in which the plurality of developing devices successively oppose a photosensitive drum due to the rotation of the rotating body so as to form a multicolor image, the apparatus having developer supplying equipment which supplies the developer to the developing devices; and collecting equipment which collects excess developer within the developing devices due to the rotation of the rotating body.

15 Claims, 10 Drawing Sheets

ROTATING TYPE DEVELOPING APPARATUS

BACKGROUND OF THE INVENTION

1. Field of the Invention

The present invention relates to a rotating type developing apparatus in the field of an electrophotographic full color image forming apparatus.

2. Description of the Related Art

To an electrophotographic full color image forming apparatus, three developing devices which are respectively filled with cyan developer, magenta developer and yellow developer are mounted, or additional one developing device which is filled with black developer is mounted. These developing devices are disposed so as to oppose one or a plurality of photosensitive drum(s), and an electrostatic latent image is visible by using successively the developers having a plurality of colors. Image formation is thereby effected.

In general, when the compactness and inexpensiveness of the apparatus is considered important, a structure is used in which the velocity of image formation somewhat decreases and in which a plurality of developing devices are disposed so as to oppose one photosensitive drum.

As a result, the inventors of the present invention propose an image forming apparatus in which a rotating body which holds four developing devices is disposed in a vicinity of one photosensitive drum, and in which by rotating the rotating body, each of the developing devices is moved to the position which opposes the photosensitive drum, and in which an electrostatic latent image is made visible by using developers.

In this image forming device, two-component developer which includes toner and carrier is used as developer. However, when the image formation is repeatedly carried out, chargeability of the two-component developer is reduced, so that it is necessary to replace the developing device and to supply a new developer. In particular, in a full color image forming apparatus, the time to replace a developing device is different for each color and the replacement is troublesome.

In order to avoid frequent replacement of the devices, it is necessary to improve the developer such as to improve charge maintainability of the carrier. Additionally, it is necessary to improve the developing device so as to be able to contain a large amount of developer.

However, if the developing device becomes large, the size and weight of the image forming apparatus is increased so that it is difficult to control the rotation of the rotating body. Accordingly, it is necessary that the developing device is as light and small as possible.

As a method of solving such problem, a developing apparatus has been proposed in which a replaceable developer supplying cartridge is mounted to a developing device in order to supply and collect developer which includes toner and carrier (see Japanese Patent Application Laid-Open (JP-A) No. 6-308829).

However, in this developing apparatus, a structure is used in which a plurality of screws are used and the developer overflowed from the developing device is collected by the developer supplying cartridge. Accordingly, the apparatus becomes large and the control mechanism becomes complicated.

Further, when the developing device and the developer supplying cartridge structured as such are mounted to the rotating body, the diameter of the rotating body is increased and the image forming apparatus becomes large. Moreover, the conveying path of the developer is complicated, so that when the rotating body is rotated, the developer may be leaked from the apparatus.

SUMMARY OF THE INVENTION

In view of the aforementioned, an object of the present invention is to provide a rotating type developing apparatus in which the structure thereof is simple, and in which by using the particular movement of a rotating body, developer can be supplied and collected without being leaked from the apparatus.

In a rotating type developing apparatus according to claim 1, developer, which at least includes toner and carrier, is accommodated within a developing device, and the developer is circulated and conveyed to a developing roll. A plurality of developing devices are held by a rotating body and successively oppose a photosensitive drum due to the rotation of the rotating body. Accordingly, a multicolor image is formed.

At the rotating type developing apparatus, developer supplying means is provided so as to supply the developer which is necessary to the developing devices. Further, by using the changes in the directions upon which gravity acts due to the rotation of the rotating body, excess developer within the developing devices is discharged.

In this way, by using the particular movement of the rotating body, the excess developer can be discharged from the apparatus having a simple structure.

Moreover, by using the rotation of the rotating body, the excess developer within the developing devices are collected by the developer cartridge through collecting means. Since the excess developer is collected by the developer cartridge in this way, there is no need to mount separately a container for collection, obviating thereby a large mounting space.

To a rotating type developing apparatus according to claim 2, a developer cartridge which supplies developer to the developing devices is removably mounted, and as occasion demands, the developer cartridge can be easily replaced. Therefore, the developing devices can be made more compact.

Further, a collecting portion, which accommodates developer collected by the collecting means, and an accommodating portion, which accommodates developer to be supplied to the developing devices, are provided at the developer cartridge. The collecting portion and the accommodating portion are partitioned such that the developer whose chargeability is reduced does not mix with a new developer. Additionally, because the collecting portion is partitioned by a vortex wall described in claim 3, the developer which has been collected by the collecting portion through the collecting means does not flow backward to the interior of the developing device due to the rotation of the rotating body.

In a rotating type developing apparatus according to claim 4, an extracting port of the collecting portion and a supplying port of the accommodating portion are provided in the vicinity of the end portion of the developer cartridge. Consequently, the configuration of the developer cartridge can be designed in a simple way. If the collecting portion is provided at the center of the developer cartridge, the collecting portion is positioned at both sides of the collecting portion. Thus, it is necessary to provide a communication passage or the like for communicating the accommodating portions at both sides, and the configuration of the developer cartridge is complicated.

In a rotating type developing apparatus according to claim 5, the collecting portion is removable from the developer cartridge. As a result, unnecessary carrier is easily processed.

In a rotating type developing apparatus according to claim 6, when the developer cartridge is replaced, retracting means rotates the rotating body and moves the developer cartridge to a removal position.

Therefore, at the time of replacement, the developer cartridge can be easily removed without contacting the photosensitive drum.

In a rotating type developing apparatus according to claim 7, the collecting portion and the developing device are communicated through a duct member, and due to the rotation of the rotating body, a collecting port of the duct member moves from a position at which the excess developer within the developing device can be collected to a position at which the developer does not flow backward. As a result, carrier can be reliably collected and a backward flow can be prevented.

In a rotating type developing apparatus according to claim 8, the collecting port of the duct member is located at a side from which the developer, which is supplied from a supplying port of the developing device and is circulated within the developing device, is conveyed. As a result, it is less likely that the carrier is mixed with the supplied new developer In a rotating type developing apparatus according to claim 9, when the developing device opposes the photosensitive drum and is disposed at a development position, the collecting port is set to an angle which is substantially parallel to the surface of the developer. Since the angle is set as such, the carrier can be reliably collected.

In a rotating type developing apparatus according to claim 10, the open surface area of the collecting port is set to the size in which the carrier in the maximum amount of developer, which is consumed by on e print, can be collected during one rotation of the rotating body. Accordingly, the carrier is collected without being leaked and the developer within the developing device does not overflow.

In a rotating type developing apparatus according to claim 11, the collecting port of the duct member is positioned so as to protrude from the lower end of the duct member in the direction from which the developer is conveyed. As a result, the conveyed carrier is easily collected and the collected carrier does not flow backward.

In a rotating type developing apparatus according to claim 12, spiral augers are disposed in parallel and the developer reaches the developing roll while being stirred and circulated within the developing device. The collecting port is positioned away from the developing roll and disposed above the vicinity of the end portions of the spiral augers. Consequently, the collecting port is not under the magnetic influence and can collect the carrier which has reached a certain level. Additionally, a partitioning plate is provided between the pair of spiral augers, and the collecting port is positioned away from the developing roll and disposed at the end portion of the partitioning plate. Thus, the carrier can be collected in a state in which the level of the developer surface is stable.

In a rotating type developing apparatus according to claim 13, the extracting port of the collecting portion and the supplying port of the accommodating portion are closed by a shutter which can be opened/closed. Therefore, when the developer cartridge is replaced, the developer is not leaked therefrom.

In a rotating type developing apparatus according to claim 14, the developer cartridge is cylindrical. When the developer cartridge is mounted to the developing device, by rotating or sliding the developer cartridge in the longitudinal direction thereof, the shutter is opened/closed. As a result, there is no need to open the shutter by hand or the like for mounting the developer cartridge.

Further, in a rotating type developing apparatus according to claim 15, the shutter is shielded by a slide cover so that the leakage of the developer is prevented by the double shield. When the developer cartridge is mounted, the slide cover slides in the axial direction thereof and exposes the shutter. Therefore, there is no need to open/close the shutter.

DESCRIPTION OF THE PREFERRED EMBODIMENTS

Figure 1:
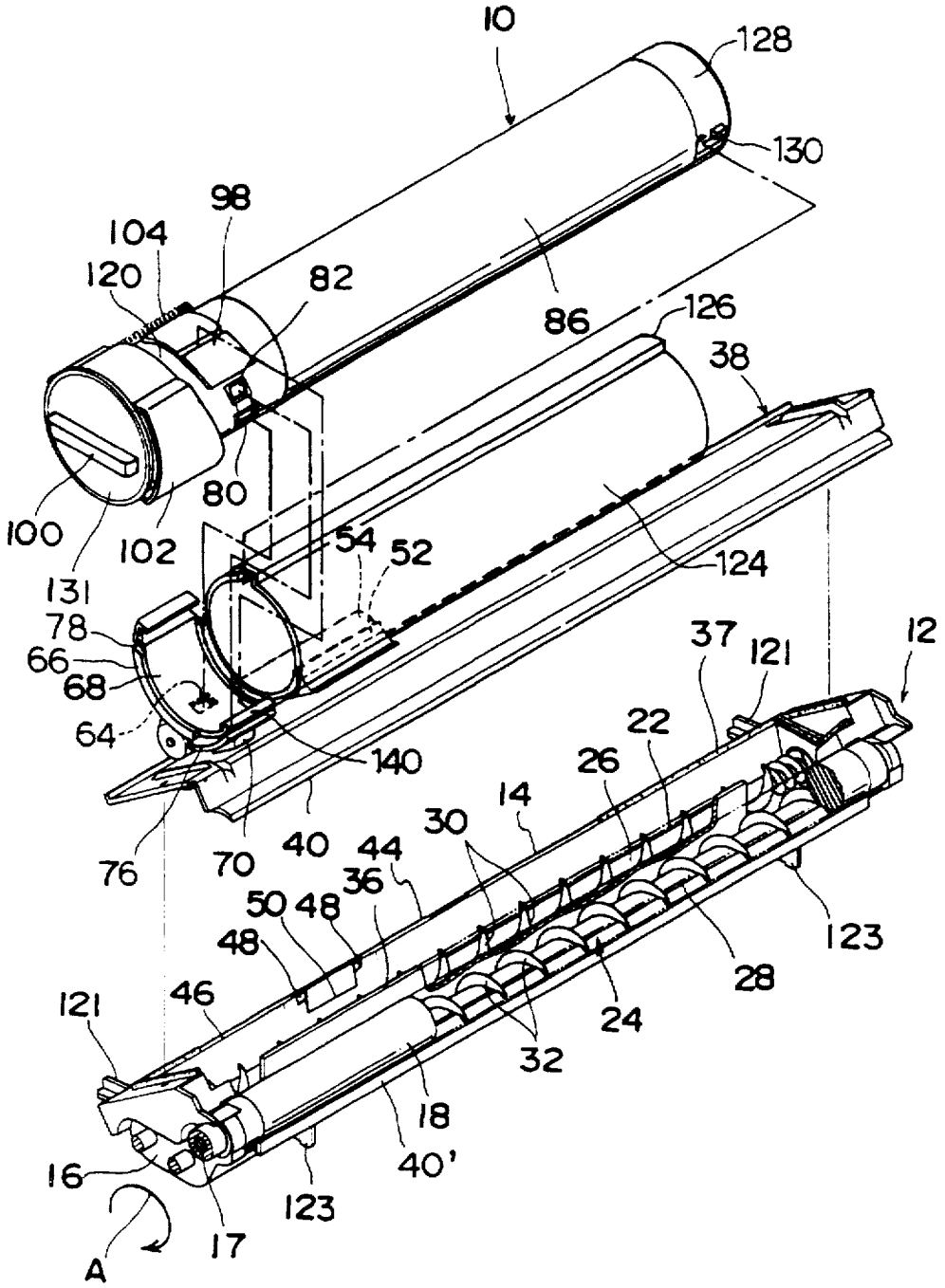
FIG. 1 is an exploded perspective view illustrating a developing device and a developer cartridge of a rotating type developing apparatus relating to a present aspect.
Figure 2:
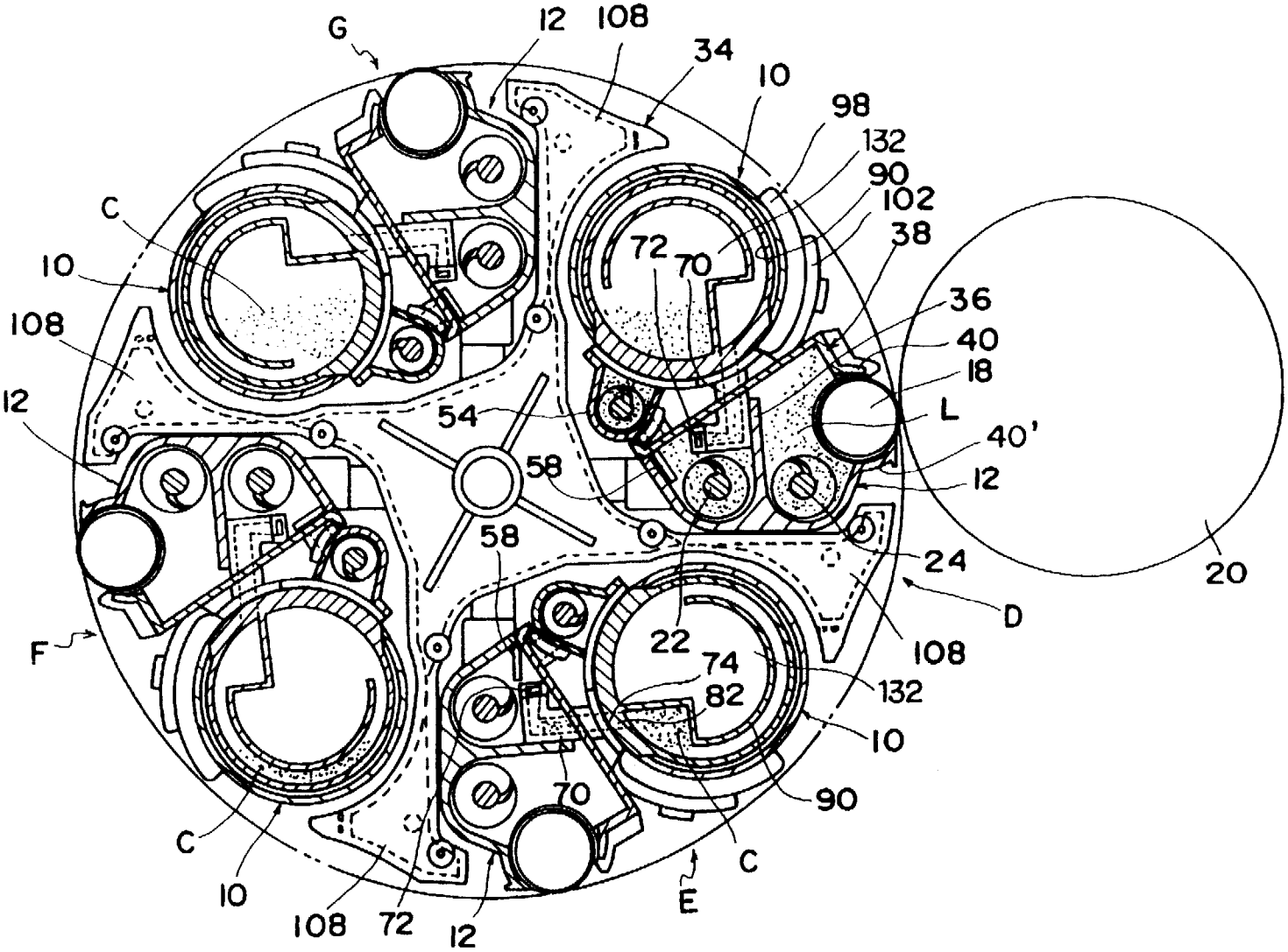
FIG. 2 is a cross sectional view illustrating a state in which the developing device and the developer cartridge are assembled to the rotating type developing apparatus relating to the present aspect.
Figure 3:
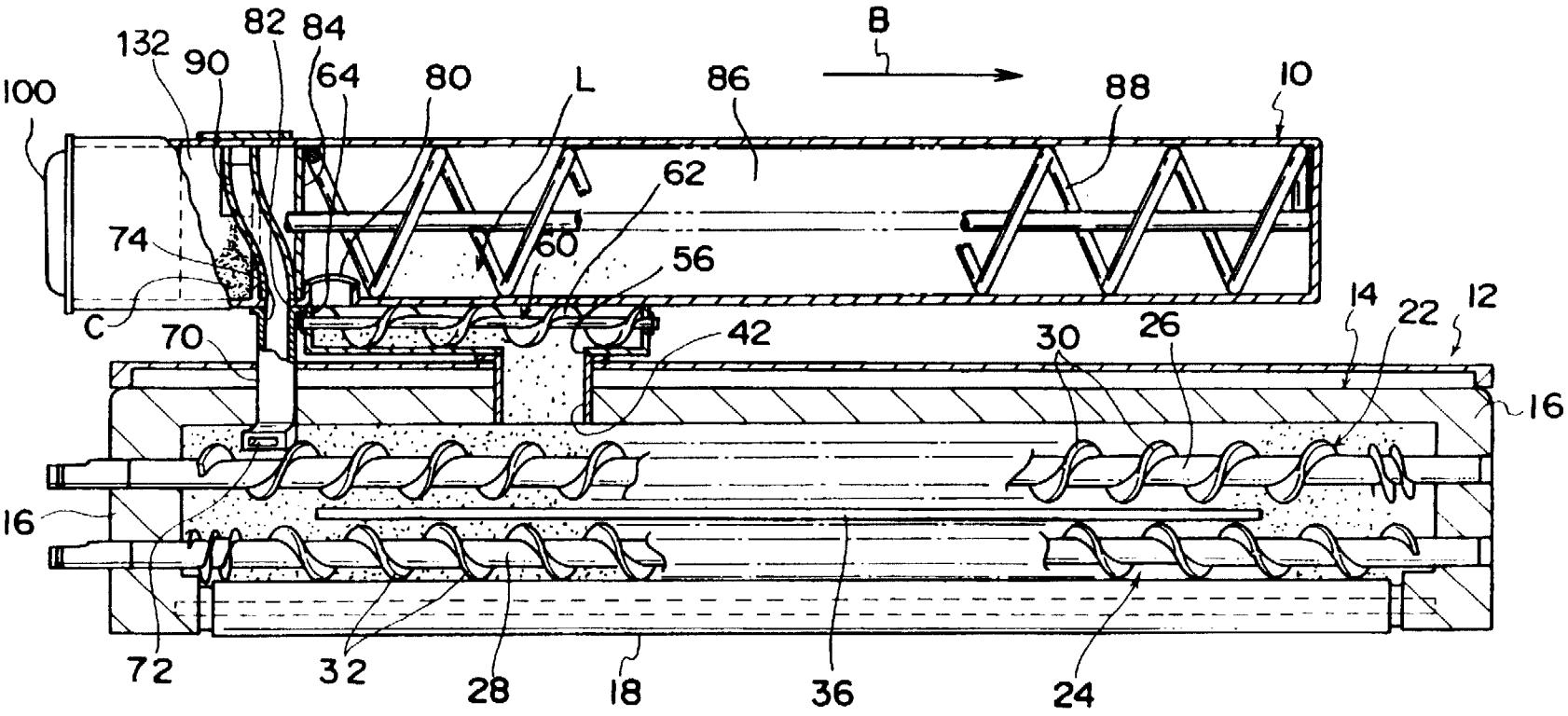
FIG. 3 is a cross sectional view illustrating a state in which the developing device and the developer cartridge of the rotating type developing apparatus relating to the present aspect are assembled.

FIGS. 1 through 3 illustrate a developer cartridge 10 and a developing device 12 which are used for a rotating type developing apparatus relating to the present aspect.

The developing device 12 includes an elongated case 14 whose upper portion is open and which is filled with developer L in which toner and carrier are premixed. A magnet roll 18 is rotatably supported at a transverse side wall 16 of the case 14 and rotated in the direction of arrow A by an unillustrated gear mechanism provided at a shaft portion 17.

The magnet roll 18 forms a magnetic brush as carrier C included in the developer L is sucked to the magnet roll 18 by magnetic force, and the magnet roll 18 supplies the toner sucked to the carrier C to a photosensitive drum 20. Accordingly, an electrostatic latent image is formed on the photosensitive drum 20.

Further, two spiral augers 22, 24 which are parallel to the magnet roll 18 are pivotably supported at the transverse side wall 16. An unillustrated gear mechanism is provided respectively at the end portion of a shaft 26 of the spiral auger 22 and at the end portion of a shaft 28 of the spiral auger 24, and the spiral augers 22, 24 rotate in a direction which is the same as the rotating direction of the magnet roll 18.

Figure 6:
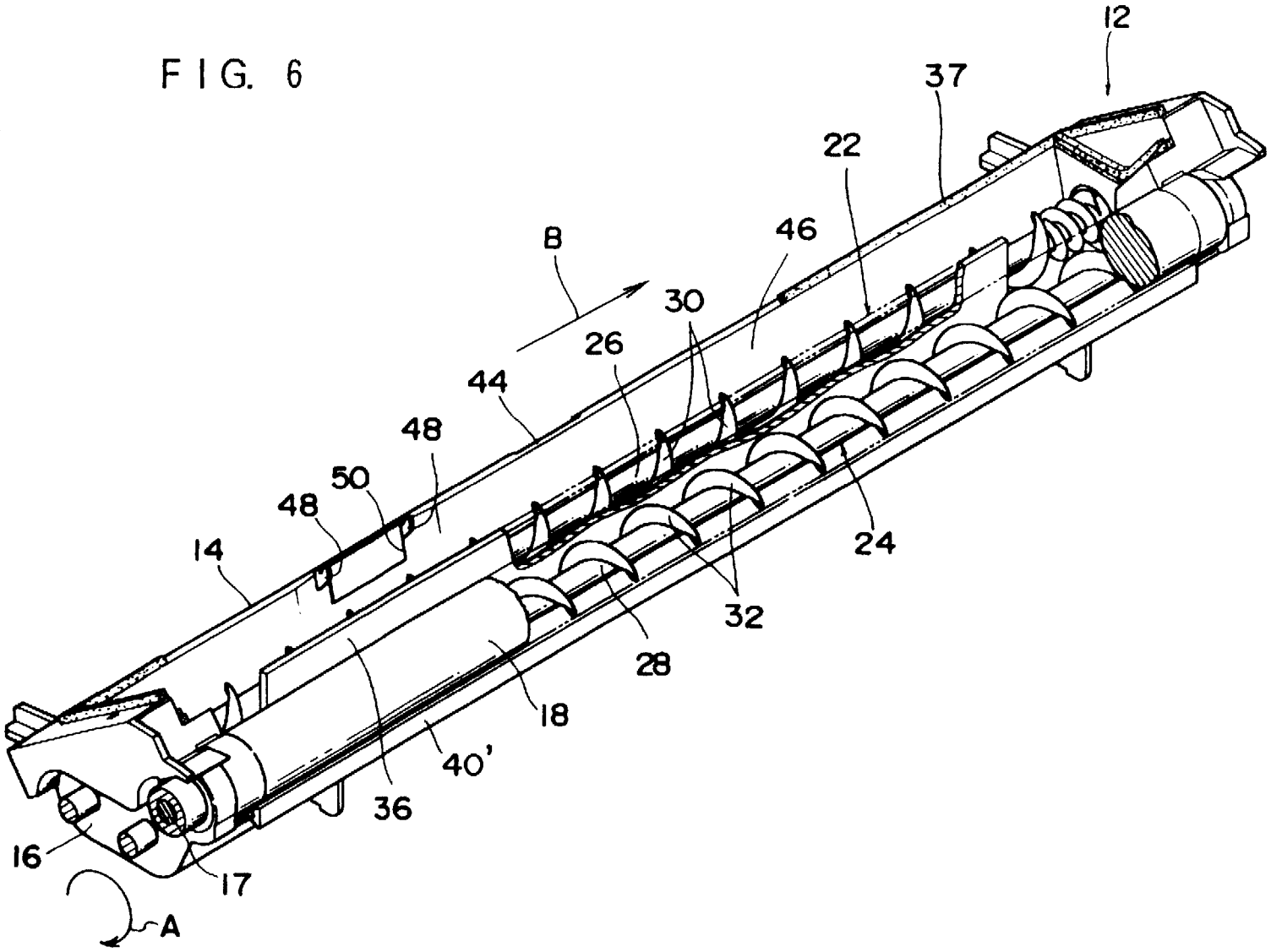
FIG. 6 is an enlarged perspective view of the developing device relating to the present aspect.

As illustrated in FIGS. 3 and 6, a spiral portion 30 which is provided at the outer circumference of the shaft 26 forms a spiral shape inclined in the direction of arrow B, and a spiral portion 32 which is provided at the outer circumference of the shaft 28 forms a spiral shape inclined in the direction opposite the direction of arrow B. As a result, when the magnet roll 18 is rotated, the spiral auger 22 stirs the developer L while conveying it in the direction of arrow B, and the spiral auger 24 stirs the developer L while conveying it in the direction opposite the direction of arrow B. Thus, the developer L is supplied to the magnet roll 18.

When the spiral augers 22, 24 are stopped, due to the rotation of the rotating body 34 which will be described later, the spiral portions 30, 32 are inclined in the direction in which the developer L circulates from the spiral auger 22 to the spiral auger 24.

Moreover, a partitioning plate 36 is provided at the developing device 12 so as to partition the spiral augers 22, 24 in the longitudinal directions thereof. The longitudinal direction end portions of the partitioning plate 36 do not reach the transverse side wall 16. In a vicinity of the right end portion of the partitioning plate 36, the developer L which has been stirred and conveyed by the spiral auger 22 is conveyed to the spiral auger 24 side. In a vicinity of the left end portion of the partitioning plate 36, the developer L which has been stirred and conveyed by the spiral auger 24 is conveyed to the spiral auger 22 side.

Further, in the vicinity of the right end portion of the partitioning plate 36, a spiral portion which is wounded reversely to the winding of the spiral portion 30 is provided at the spiral auger 22. Also, in the vicinity of the left end portion of the partitioning plate 36, a spiral portion which is wounded reversely to the winding of the spiral portion 32 is provided at the spiral auger 24. As a result, the partitioning plate 36 forms a borderline region between the spiral augers 22 and 24 and the developer L smoothly circulates therebetween.

On the other hand, a packing 37 is stuck to the open edge portion of the case 14 and the case 14 is sealed by a long lid 38. A collar 40 is provided at the long lid 38. The magnet roll 18 is held between the collar 40 and a collar 40' formed at the case 14 in a state in which the outer circumferential portion of the magnet roll 18 is partially exposed.

Moreover, an unillustrated pawl is provided at the long lid 38. The pawl engages a concave portion 44 formed at the case 14 so that the long lid 38 is temporarily held at the case 14.

Figure 5:
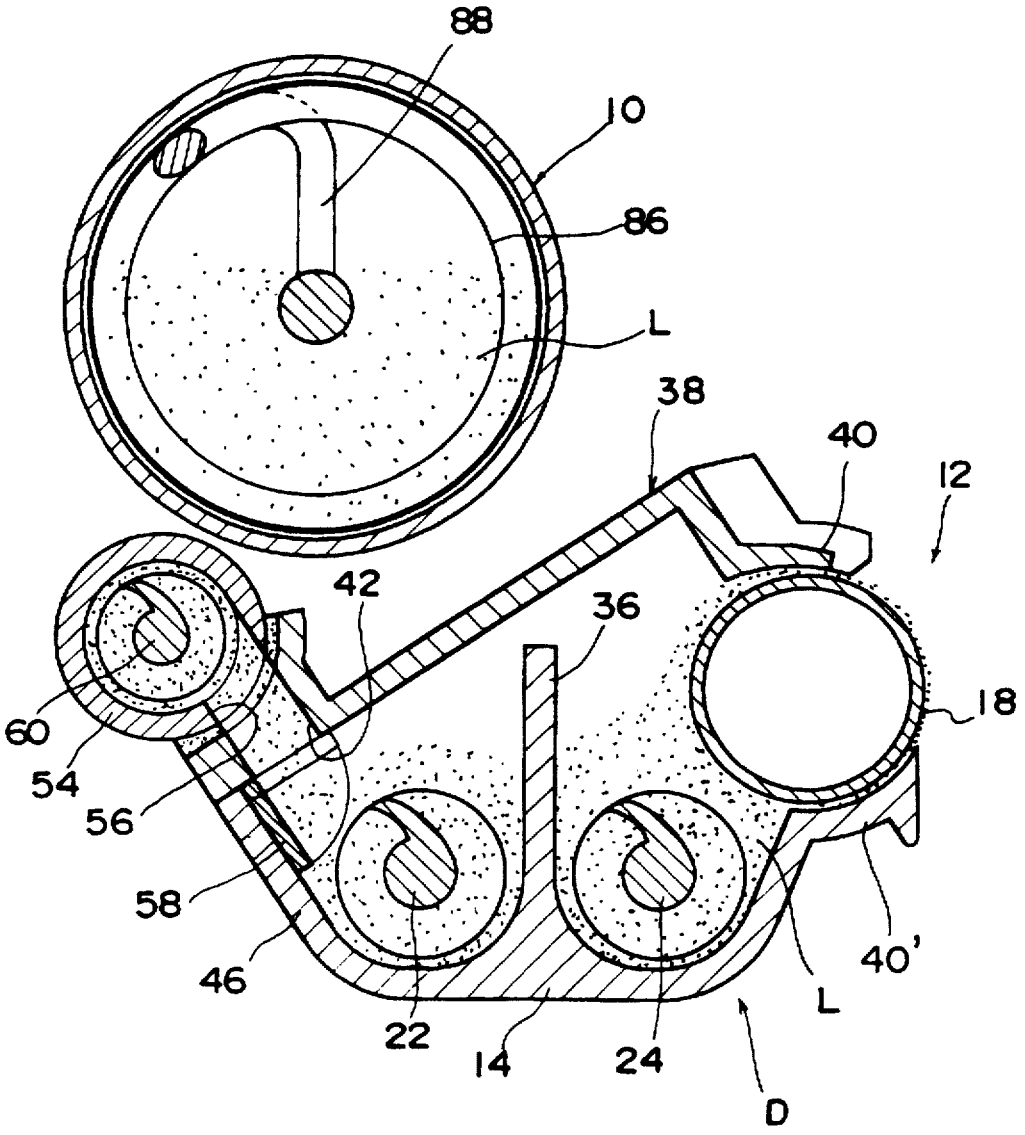
FIG. 5 is an enlarged cross sectional view showing an accommodating portion of the developing device of the rotating type developing apparatus relating to the present aspect.

A rectangular supplying port 42 (see FIG. 5) penetrates through the long lid 38 on the left-hand side of the central portion thereof. The open edge of the reverse surface side of the supplying port 42 slightly caves in and a pair of engaging pawls 48 provided at a longitudinal side wall 46 of the case 14 engage the open edge, such that the supplying port 42 is thereby positioned with respect to the case 14.

Further, a concave portion 50, at which the longitudinal side wall 46 is recessed, is formed between the engaging pawls 48, and the size of the case 14 is partially increased. Accordingly, the developer L which is supplied from the supplying port 42 smoothly flows into the case 14.

Figure 4:
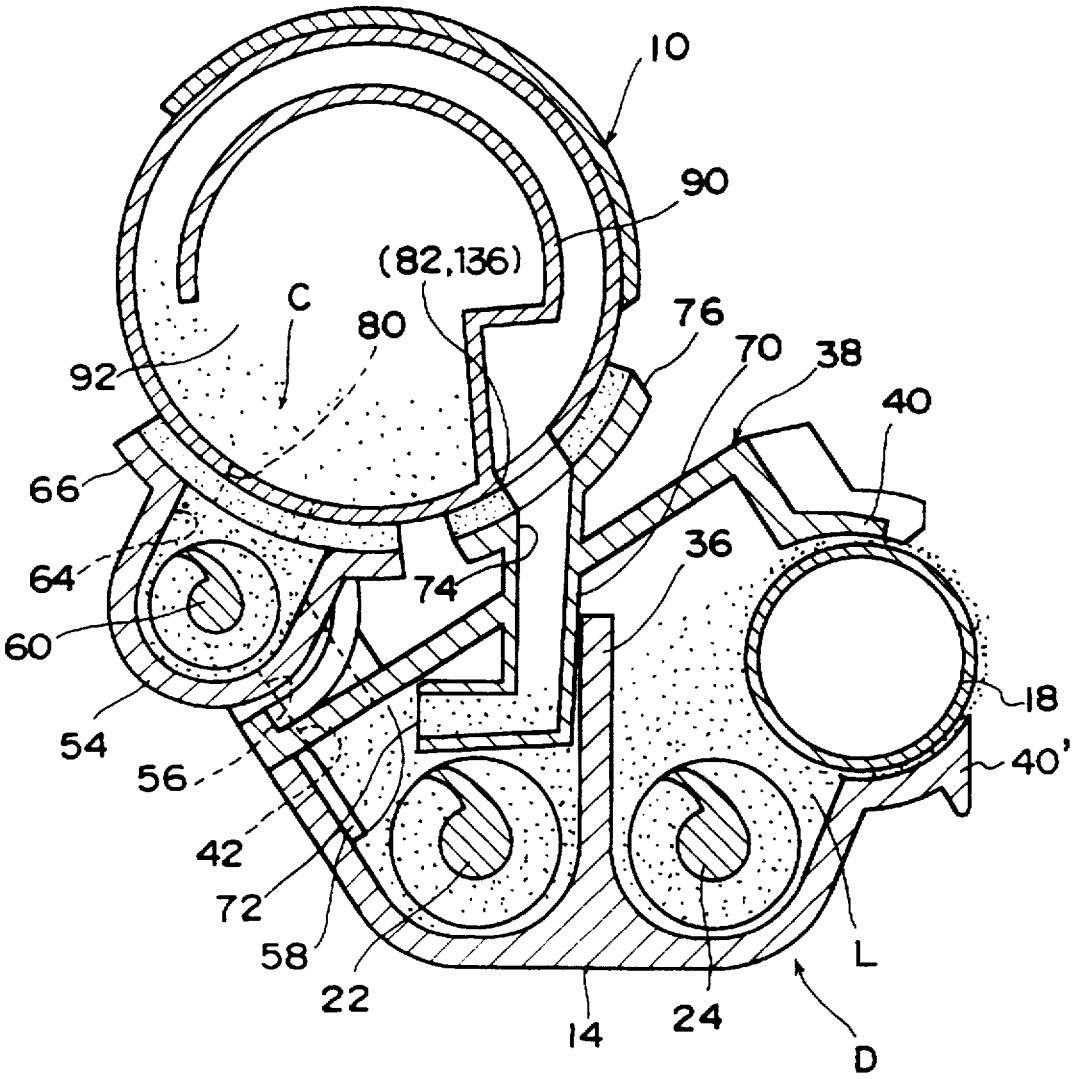
FIG. 4 is an enlarged cross sectional view showing a collecting portion of the developing device of the rotating, type developing apparatus relating to the present aspect.

Moreover, a mounting plate 52 is provided so as to be upright at the front side of the supplying port 42. The side surface of the mounting plate 52 is bent in the form of an arc and the substantially cylindrical casing 54 is attached to the arc-shaped surface. As shown in FIGS. 3 and 4, an open portion 56 is formed at the outer circumferential surface of the casing 54 so as to communicate with the supplying port 42. A flap 58 is provided at the peripheral edge of the supplying port 42, such that the supplying port 42 is opened/closed depending on the positions at which the rotating body 34, which will be described later, rotates (changes in the directions upon which gravity acts).

Additionally, a spiral auger 60 is disposed within the casing 54. The configuration of the spiral portion 62 of the spiral auger 60 is the same as that of the spiral portion 30 of the spiral auger 22, and the developer L is conveyed in the direction of arrow B.

Figure 7:
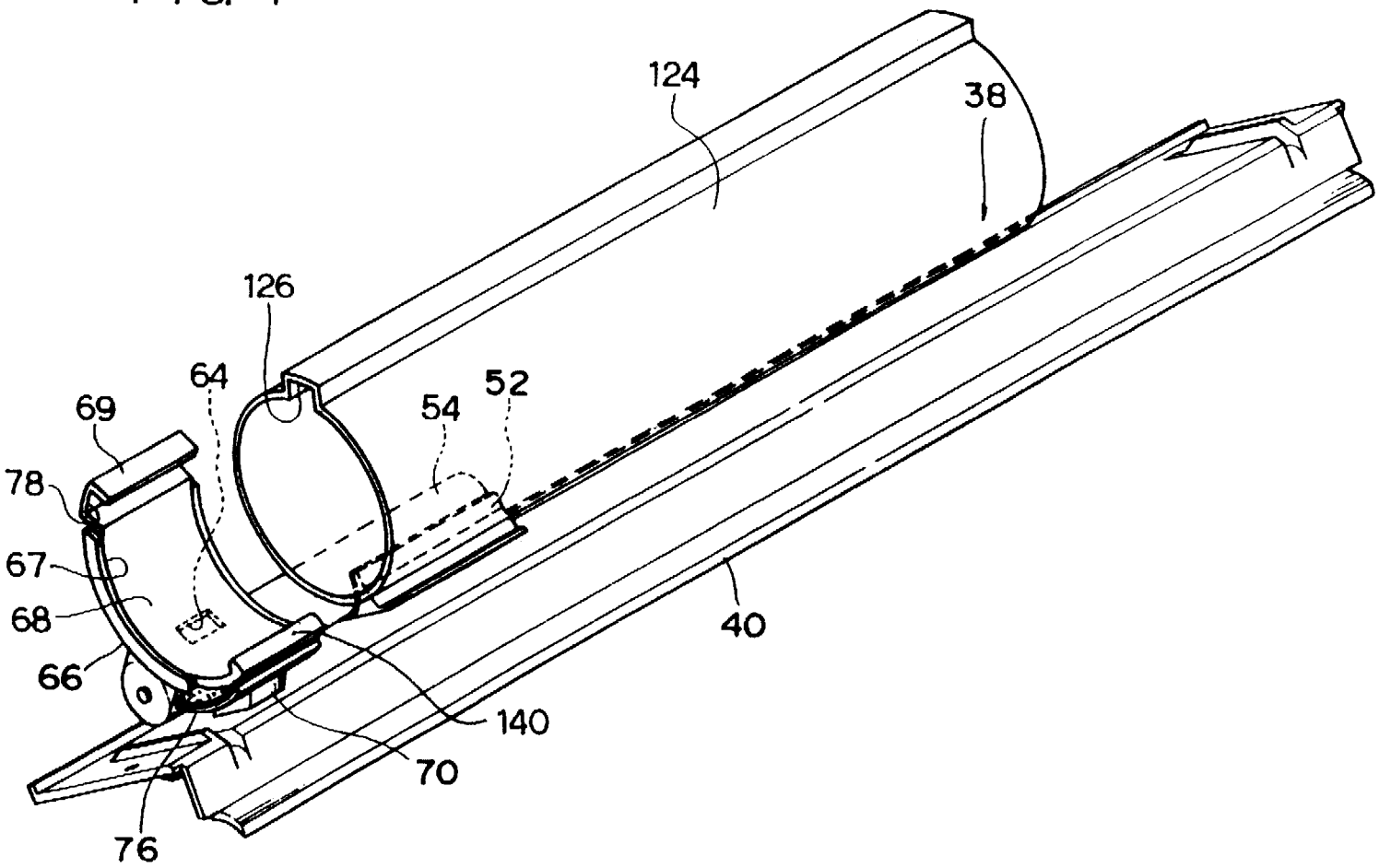
FIG. 7 is an enlarged perspective view of a long lid of the developing device relating to the present aspect.
Figure 8:
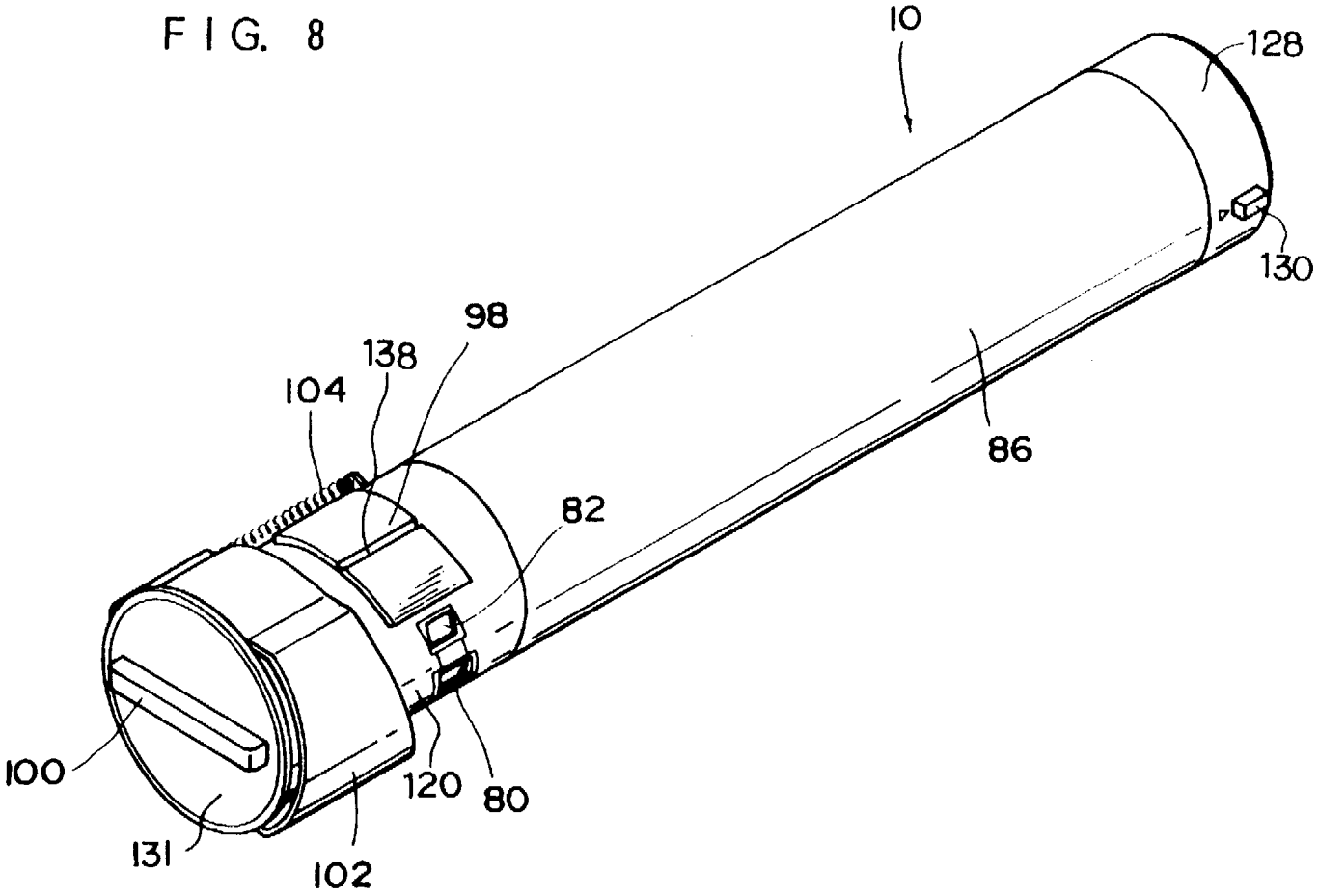
FIG. 8 is an enlarged perspective view of the developer cartridge relating to the present aspect.

As shown in FIG. 7, a receiving plate 66, which is bent so as to form a semicircle and in which a guide groove 67 is formed at both sides thereof, is mounted to the outer circumferential surface of the left-hand side of the casing 54. A mounting port 64 opens at the receiving plate 66. Additionally, a receiving plate 76 which is bent in the shape of an arc is provided on the extending line of the receiving plate 66, and a discharge duct 70 penetrates through the receiving plate 76.

The discharge duct 70 is bent in the shape of L, and the collecting port 72 disposed within the case 14 is directed to a further upstream side than the supplying port 42 (the direction in which the developer is conveyed by the spiral auger 22). Further, when the magnet roll 18 opposes the photosensitive drum 20, the collecting port 72 is provided so as to be parallel to the surface of the developer L. The open surface area of the collecting port 72 is set to the size in which carrier C in the maximum amount of developer L, which is consumed by a sheet of printing paper having 100% image density, can be collected during one rotation of the rotating body 34.

On the other hand, a slide shutter 68, which is bent so as to form a cylindrical shape, slidably engages the guide grooves 67 of the receiving plate 66. An engaging wall 69 is formed at the upper end of the slide shutter 68. The engaging wall 69 abuts the end portion of the receiving plate 66 and stops at the position at which the slide shutter 68 shields the receiving port 64 and the discharge port 74.

Figure 9:
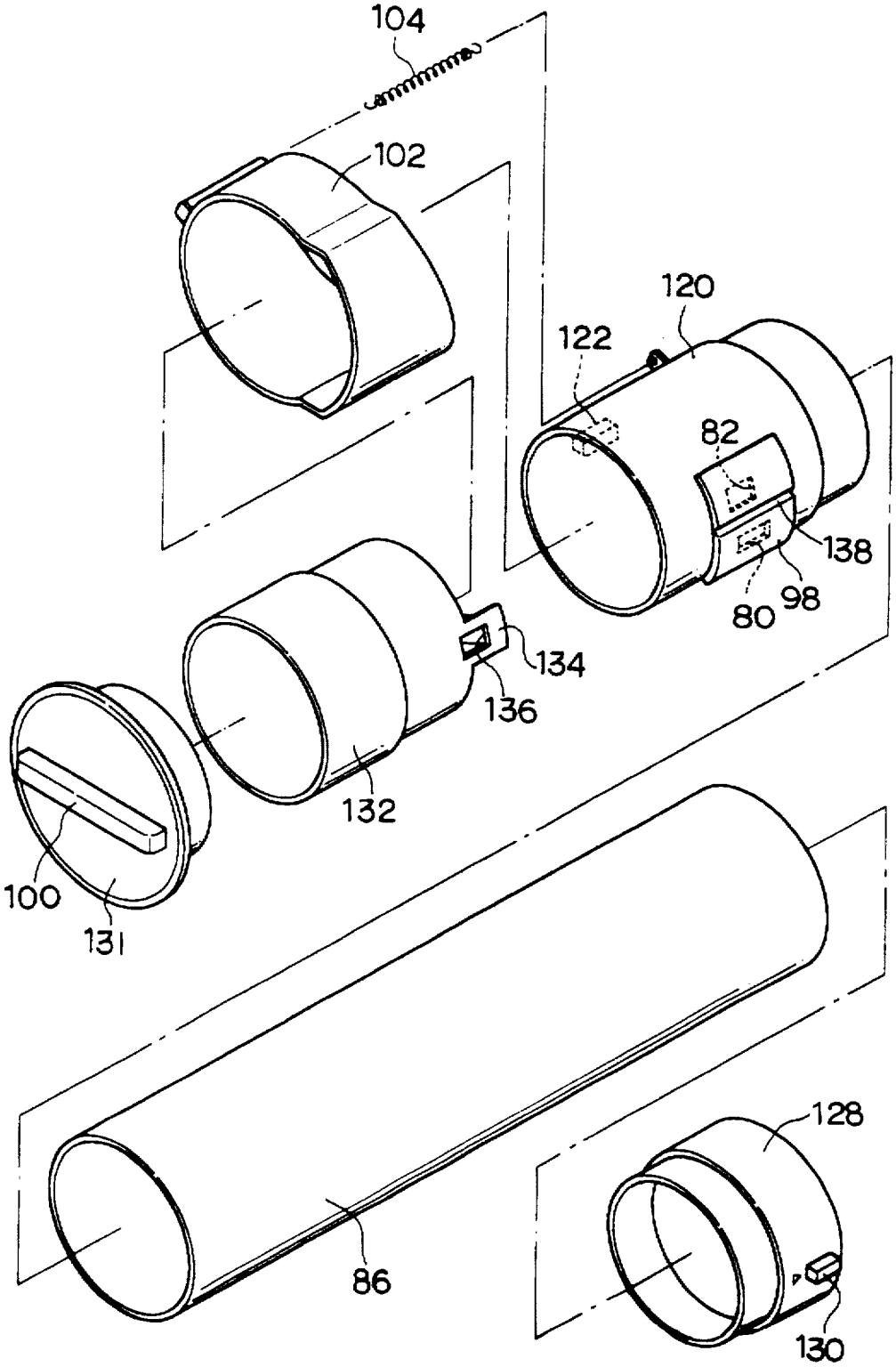
FIG. 9 is an exploded perspective view of the developer cartridge relating to the present aspect.

Further, an engaging groove 78 is notched at the engaging wall 69 in the transverse direction thereof. When the developer cartridge 10 is attached, the engaging groove 78 engages an engaging piece 122 which protrudes from a collecting case 120 shown in FIG. 9.

Moreover, a cylindrical holder 124 whose ends are open is fixed to the upper surface of the long lid 38. At the inner circumferential wall of the holder 124, a guide groove 126 extends along the longitudinal direction thereof. A guide projection 130 which protrudes from a lower cap 128 of the developer cartridge 10 engages the guide groove 126, and the developer cartridge 10 is attached to the holder 124.

The developer cartridge 10 includes a cylindrical accommodating portion 86 and the cylindrical collecting case 120 which is fitted through the opening of the accommodating portion 86. At the outer circumferential surface of the collecting case 120, a supplying port 80 is formed at the position corresponding to the receiving port 64 and an extracting port 82 is formed at the position corresponding to the discharge port 74.

Further, a cylindrical collecting box 132, into which a cap 131 is press-fitted, fits into the collecting case 120. When the collecting box 132 is fitted into the collecting case 120, the bottom wall of the collecting box 132 becomes a partitioning wall 84 (see FIG. 3) so as to partition the supplying port 80 and the extracting port 82. In this way, the developer L accommodated in the accommodating portion 86 does not flow into the collecting box 132. A portion of the partitioning wall 84 juts out toward the longitudinal direction thereof and forms a jutting-out piece 134. When the collecting box 132 is fitted into the collecting case 120, an opening 136 which is punched at the jutting-out piece 134 communicates with the extracting port 82. Accordingly, carrier is collected by the collecting box 132 through the discharge port 74, the extracting port 82 and the opening 136. As shown in FIG. 3, an agitator 88 is disposed at the accommodating portion 86 so as to stir and convey the accommodated developer L to the supplying port 80.

Moreover, unillustrated taping is effected upon a connecting portion between the collecting case 120 and the collecting box 132, and only the collecting box 132 can be removed therefrom as occasion demands. Consequently, it is easy to handle the carrier C which has been stored in the collecting box 132. Further, the size of the collecting box 132 is set so that the carrier C in the developer L which has been contained in the developer cartridge 10 can be fully collected.

As illustrated in FIG. 4, a collecting passage 90, which forms a substantially circular shape from the opening 136, is formed at the collecting box 132. The carrier C is not flowed backward toward the discharge port 74 side by the collecting passage 90.

On the other hand, the peripheries of the supplying port 80 and the extracting port 82 are undercut along the circumferential direction of the collecting case 120 so as to form an unillustrated guide groove. A shutter 98, which is bent in an arc-shape along the developer cartridge 10, is slidably mounted to the guide groove in the circumferential direction thereof. A long groove 138 is formed at the upper surface of the shutter 98 in the transverse direction thereof. The long groove 138 engages a projection 140 which is projected from the lower end of the receiving plate 76. When a user pinches and turns a long plate-shaped handle 100 provided at the cap 131 with his/her fingers, the developer cartridge 10 swivels so that the supplying port 80 and the extracting port 82 are opened/closed.

Further, a cylindrical slide cover 102 is slidably attached so as to enclose the collecting case 120. The slide cover 102 is urged by a spring 104 in the direction in which the shutter 98 is shielded. As a result, when the developer cartridge 10 is not attached to the rotating body 34, the shutter 98 is shielded due to the urging force of the spring 104. When the developer cartridge is attached to the rotating body 34, the inclined open end of the slide cover 102 abuts an unillustrated stopper of the device, and due to the inserting operation of the developer cartridge 10, the shutter 98 is exposed.

On the other hand, as shown in FIG. 2, the rotating type developing apparatus includes the photosensitive drum 20, and the substantially cruciate rotating body 34 is disposed on the side of the photosensitive drum 20. To an arm 108 of the rotating body 34, an engaging plate 121 which protrudes from the case 14 in the transverse direction thereof and a supporting plate 123 which is disposed beneath the case 14 are fixed, and the developing device 12 is mounted.

The developer L, which includes C(cyan), M(magenta), Y(yellow) and BK(black) and in which toner and carrier are premixed, is accommodated within the developing device 12 and the developer cartridge 10.

Moreover, an unillustrated density sensor is disposed at the photosensitive drum 20, such that the sensor detects at certain intervals the density of an image which has been formed on the photosensitive drum 20 by the toner. When the density becomes light, a signal is sent to a microcomputer and the microcomputer rotates the rotating body 34 clockwise. Next, a limit switch is operated and the rotating body 34 is halted. The developer cartridge 10 moves to the position (a position F in FIG. 2) from which the developer cartridge 10 is taken out. A case may be carried out in which when the door of the rotating type developing apparatus is opened, the limit switch is operated, the rotating body 34 is driven, and the developer cartridge 10 is moved to the position at which the developer cartridge 10 is replaced.

Next, the operation of the rotating type developing apparatus relating to the present aspect will be explained.

The photosensitive drum 20 is charged by a charge roller and exposed by a laser beam serving as a writing element so as to form an electrostatic latent image thereon. As the rotating body 34 is rotated, the magnet roll 18 of the developing device 12, within which the developer L including C(cyan), M(magenta), Y(yellow) and BK(black) is accommodated, successively opposes the photosensitive drum 20. The electrostatic latent image in full colors is thereby formed.

In this way, the developed image on the photosensitive drum 20 is transferred onto a paper sent by a conveying roller.

Additionally, the spiral augers 22, 24 are rotated by the gear mechanism. The developer L is stirred while being conveyed from the spiral auger 22 to the spiral auger 24 and is supplied to the magnet roll 18.

As illustrated in FIG. 2, when the developing device 12 is placed at a position D, the flap 58 opens the supplying port 42 (see FIG. 5) and the developer L is supplied from the developer cartridge 10 through the casing 54, if necessary.

At this time, as illustrated in FIG. 4, the collecting port 72 of the discharge duct 70 is parallel to the surface of the developer L and faces the upstream side of the conveying direction of the developer L (see FIG. 3). As a result, in a state in which it is less likely that a new developer supplied from the developer cartridge 10 is mixed with the developer in the developing device 12, the excess developer within the developing device 12 is reliably conveyed from the collecting port 72 to the discharge duct 70. Further, since the collecting port 72 is disposed away from the magnet roll 18, the collecting port 72 is not under the magnetic influence.

Next, as shown in FIG. 2, when the rotating body 34 rotates and the developing device 12 reaches a position E, the flap 58 is half-open and the collecting port 72 faces upward. Thus, the developer conveyed to the discharge duct 70 does not flow backward and flows to the discharge port 74 side. The developer, which has passed through the discharge port 74, passes through the extracting port 82, the opening 136 and the circular collecting passage 90. Then, the developer is dropped into the collecting box 132 while the developing device 12 is moved from the position F to a position G.

Figure 10:
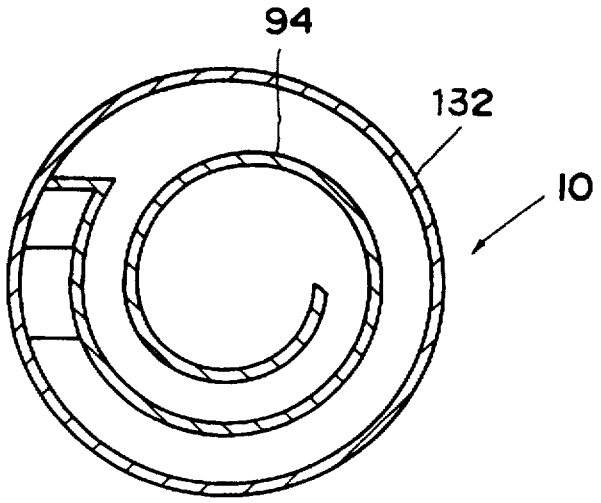
FIG. 10 is a cross sectional view showing a variant example of the collecting portion of the developer cartridge relating to the present aspect.

Since the circular collecting passage 90 is provided in this way, the collected developer does not flow backward to the developing device 12. Note that the configuration of the collecting passage 90 is not limited to that of the present aspect. As illustrated in FIG. 10, a vortex wall 94 which forms a vortex toward the center of the collecting box 132 may be formed thereat.

As illustrated in FIG. 3, because the collecting box 132 and the accommodating portion 86 for the developer L are divided by the partitioning wall 84, the collected developer is not mixed with a new developer within the developer cartridge 10.

Next, while the developing device 12 moves from the position G to the position D, the flap 58 opens again and the collecting port 72 of the discharge duct 70 is parallel to the surface of the developer L.

Due to the function of the agitator 88, the developer L within the accommodating portion 86 is conveyed to the supplying port 80. The developer L is conveyed to the interior of the casing 54 through the receiving port 64, and further is reached the open portion 56 by the spiral auger 60. The developer L is supplied from the open portion 56 to the interior of the developing device 12 through the supplying port 42 of the long lid 38.

In this way, by using effectively the changes in the acting directions of gravity caused by the rotation of the rotating body 34, the excess developer within the developing device 12 can be collected by the apparatus having a simple structure.

Moreover, when the developer cartridge 10 is replaced, the handle 100 is rotated. Then, the developer cartridge 10 is rotated, and the extracting port 82 and the supplying port 80 are shielded by the shutter 98. At the same time, the slide shutter 68 slides and the engaging wall 69 abuts the end portion of the receiving plate 66, so that the slide shutter 68 stops at the position at which the receiving port 64 and the discharge port 74 are shielded. As a result, the developer remained in the developer cartridge 10 is not leaked therefrom. Also, since the receiving port 64 and the discharge port 74 are shielded, the toner is not leaked from the developing device 12.

Because the guide groove 126 of the holder 124 engage the guide projection 130 in this state, the developer cartridge 10 can be removed from the holder 124. When the developer cartridge 10 is removed, the slide cover 102 shields the shutter 98 due to the urging force of the spring 104, and the extracting port 82 and the supplying port 80 are shielded twice. Consequently, when the developer cartridge 10 is replaced, the developer is not leaked therefrom.

Further, when the developer cartridge 10 is replaced, since the rotating body 34 rotates and moves to a predetermined position, the developer cartridge 10 can be removed from the holder 124 without contacting the photosensitive drum 20.

Because the present invention is structured as described above, the structure thereof is simple and the developer can be supplied and collected by using the particular movement of the rotating body.

What is claimed is:

1. A rotating type developing apparatus, comprising:

a plurality of developing devices which convey developer, which at least includes toner and carrier, to a developing roll while accommodating and circulating the developer; and a rotating body which holds and rotates said plurality of developing devices, in a rotating type developing apparatus in which said plurality of developing devices successively oppose a photosensitive drum due to the rotation of said rotating body so as to form a multicolor image, said apparatus comprising:

developer supplying means which supplies the developer to said developing devices; and collecting means which collects excess developer within said developing devices due to the rotation of said rotating body.

2. A rotating type developing apparatus according to claim 1, wherein said developer supplying means is a removable developer cartridge divided into a collecting portion, which accommodates developer collected by said collecting means, and an accommodating portion, which accommodates developer to be supplied to said developing devices, and means for preventing the developer from flowing backward to said developing devices is provided between said collecting portion and said accommodating portion.

3. A rotating type developing apparatus according to claim 2, wherein said backward flow preventing means is a vortex wall.

4. A rotating type developing apparatus according to claim 2, wherein said collecting portion includes a developer extracting port, said accommodating portion includes a developer supplying port, and the extracting port and the supplying port are provided in the vicinity of an end portion of said removable developer cartridge.

5. A rotating type developing apparatus according to claim 2, wherein said collecting portion is removable from said removable developer cartridge.

6. A rotating type developing apparatus according to claim 2, further comprises retracting means for rotating said rotating body and shifting said removable developer cartridge to a removal position, when said removable developer cartridge is replaced.

7. A rotating type developing apparatus according to claim 2, wherein said collecting means is formed by a duct member through which said collecting portion and said developing devices are communicated, and due to the rotation of said rotating body, a collecting port of said duct member moves from a position at which the excess developer within said developing devices can be collected to a position at which the developer does not flow backward.

8. A rotating type developing apparatus according to claim 7, wherein said collecting port is located at a side from which the developer, which is supplied from a developer supplying port provided within said developing devices and is circulated within said developing devices, is conveyed.

9. A rotating type developing apparatus according to claim 7, wherein when said developing devices oppose said photosensitive drum and are disposed at a development position, said collecting port is set to an angle which is substantially parallel to a surface of the developer.

10. A rotating type developing apparatus according to claim 7, wherein an open surface area of said collecting port is set to a size in which carrier in a maximum amount of developer, which is consumed by one print, can be collected during one rotation of said rotating body.

11. A rotating type developing apparatus according to claim 7, wherein said collecting port is positioned so as to protrude from the lower end of said duct member in a direction from which the developer is conveyed.

12. A rotating type developing apparatus according to claim 7, wherein said developing devices further comprise a developer conveying/stirring member formed by spiral augers having end portions, said spiral augers disposed in parallel with a partitioning plate provided therebetween, and wherein said collecting port is positioned at an end portion of the partitioning plate and is away from said developing roll, said collecting port being positioned above the vicinity of the end portions of said spiral augers.

13. A rotating type developing apparatus according to claim 4, wherein the extracting port of said collecting portion and the supplying port of said accommodating portion are closed by a shutter which can be opened/closed.

14. A rotating type developing apparatus according to claim 13, wherein said removable developer cartridge is cylindrical, and said shutter is opened when said removable developer cartridge is rotated or slid in the longitudinal direction of said removable developer cartridge, and is closed when said developer is removed from said developing devices.

15. A rotating type developing apparatus according to claim 14, wherein a slide cover is further provided such that, when said removable developer cartridge is mounted, said shutter is exposed, and when said removable developer cartridge is removed, said shutter is shielded.

* * * * *